US005475880A

United States Patent [19]

Guenther

[11] Patent Number: 5,475,880

[45] Date of Patent: Dec. 19, 1995

[54] FOLDABLE BATHTUB TRANSFER SEAT

[75] Inventor: Torbett B. Guenther, 8992 Tamarack Ct., Plymouth, Mich. 48170

[73] Assignees: Torbett B. Guenther; Dolores Guenther, both of Plymouth, Mich.

[21] Appl. No.: 342,619

[22] Filed: Nov. 21, 1994

[51] Int. Cl.[6] ..... A47K 3/12

[52] U.S. Cl. ..... 4/578.1; 4/571.1; 297/440.1; 108/67

[58] Field of Search ..... 4/528, 529, 530, 4/531, 560.1, 571.1, 573.1, 578.1, 579, 611; 108/67; 297/440.1; 5/191, 236.1, 238; 198/850

[56] References Cited

U.S. PATENT DOCUMENTS

| | | | |
|---|---|---|---|
| 561,290 | 6/1896 | Stephenson | 4/579 |
| 573,428 | 12/1896 | Yost | 5/236.1 X |
| 726,046 | 4/1903 | Grabs | 5/238 |
| 987,646 | 3/1911 | Schmidt | 4/579 |
| 2,551,976 | 5/1951 | Smith | 5/236.1 X |
| 2,571,337 | 10/1951 | Burnham | 5/191 X |
| 5,090,337 | 2/1992 | Magistrelli | 108/67 |

*Primary Examiner*—Robert M. Fetsuga
*Attorney, Agent, or Firm*—Barnes, Kisselle, Raisch, Choate, Whittemore & Hulbert

[57] ABSTRACT

A foldable bathtub seat that includes a plurality of elongated parallel generally rectangular slats interconnected by hinges such that the slats are foldable to a configuration in which the slats are in stacked facing engagement parallel to each other and unfoldable to a configuration in which the slats are in a planar array. A rider at one end of each of the slats cooperates with a track affixed to a wall adjacent to the bathtub rim such that the slats are foldably and unfoldably supported by the bathtub rim while extending across the rim. In the unfolded configuration, the coplanar slats form a transfer seat supported along one end by the track affixed to the wall, and along the other end by the wall-remote edge of the bathtub rim. In the folded configuration, the seat may be readily removed for full access to the tub.

16 Claims, 5 Drawing Sheets

FOLDABLE BATHTUB TRANSFER SEAT

The present invention is directed to a seat for placement on a bathtub rim to assist a user in transferring into and out of the bathtub.

BACKGROUND AND SUMMARY OF THE INVENTION

A general object of the present invention is to provide a seat for assisting a user in transferring into and out of a bathtub that is economical to manufacture, that is durable in use, that may be readily folded and unfolded by a user, and that may be readily assembled at a tub for use and removed to afford full access to the tub or for storage when not in use.

A foldable bathtub seat in accordance with a presently preferred embodiment of the invention comprises a plurality of elongated parallel generally rectangular slats (i.e., at least two) interconnected by hinges such that the slats are foldable to a configuration in which the slats are in stacked facing engagement parallel to each other and unfoldable to a configuration in which the slats are in a planar array. A rider at one end of each of the slats cooperates with a track affixed to a wall adjacent to a bathtub rim such that the slats are foldably and unfoldably supported by the bathtub rim while extending across the rim. In the unfolded configuration, the coplanar slats form a transfer seat supported along one end by the track affixed to the wall, and along the other end by the wall-remote edge of the bathtub rim. In the folded configuration, the seat may be readily removed for full access to the tub.

The track in the preferred embodiment of the invention comprises a length of channel stock of stainless steel composition, for example, carried at opposed ends by support blocks that are fastened to the wall. The upper edge of the channel stock is spaced from the wall to receive the slat riders. The length of the channel and separation between the support blocks is greater than the width of the slat array, so that there is room for limited sliding motion of the slat array along the length of the track. Tongues on the support blocks engage grooves on the opposed rider to prevent removal of the end slat that abuts a support block. Friction pads beneath the wall-remote ends of the slats help prevent sliding along the tub rim. The slat hinges comprise hinge pins in the slats and hinge clips pivotally embracing the hinge pins in adjacent slats. Preferably, the slats are of molded plastic composition, with the hinge pins being molded therein.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figures 1, 3:
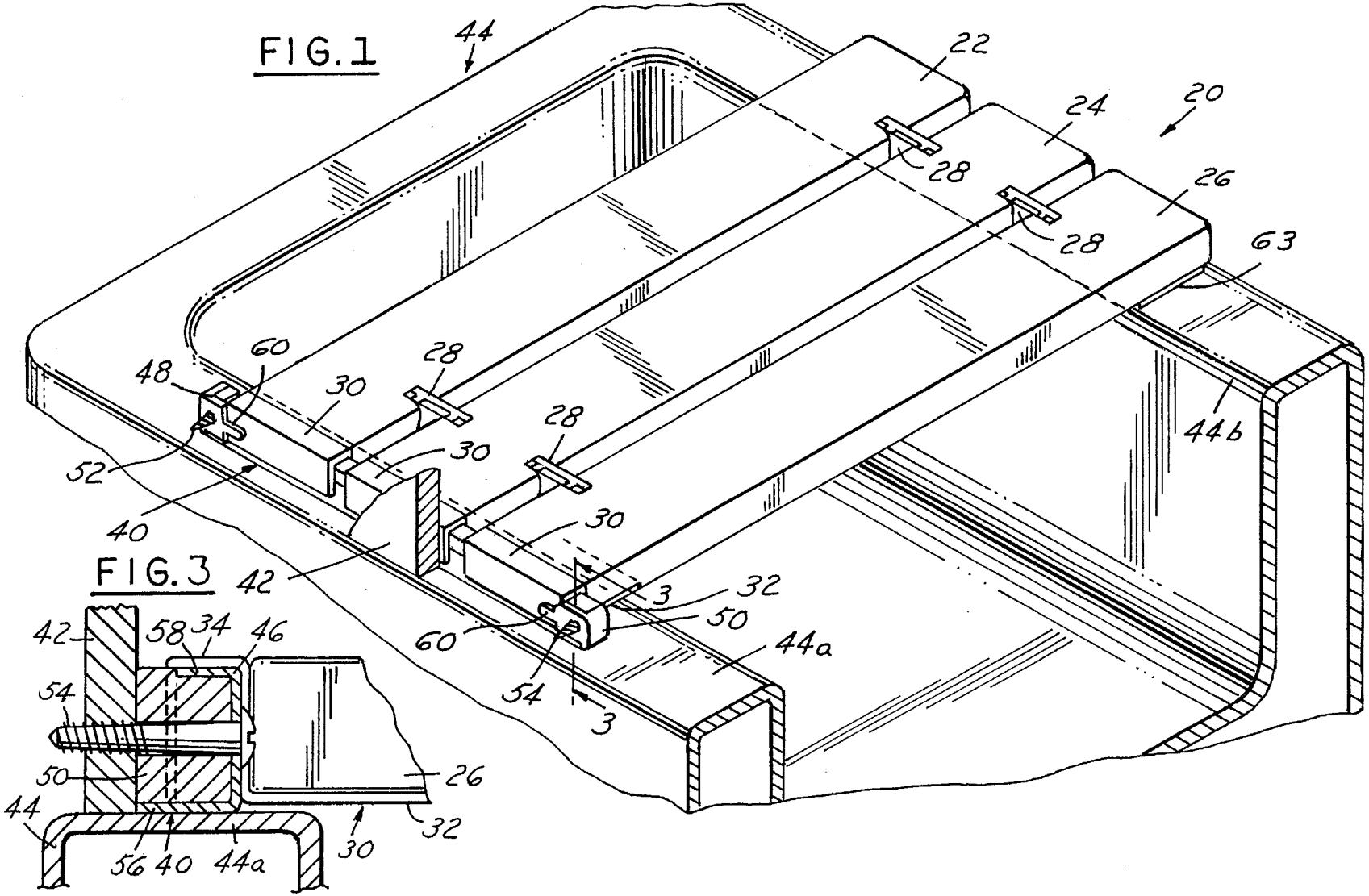
FIG. 1 is a perspective view of a foldable bathtub seat in accordance with a presently preferred embodiment of the invention.
FIG. 3 is a fragmentary sectional view taken substantially along the line 3—3 in FIG. 1.
Figure 2:
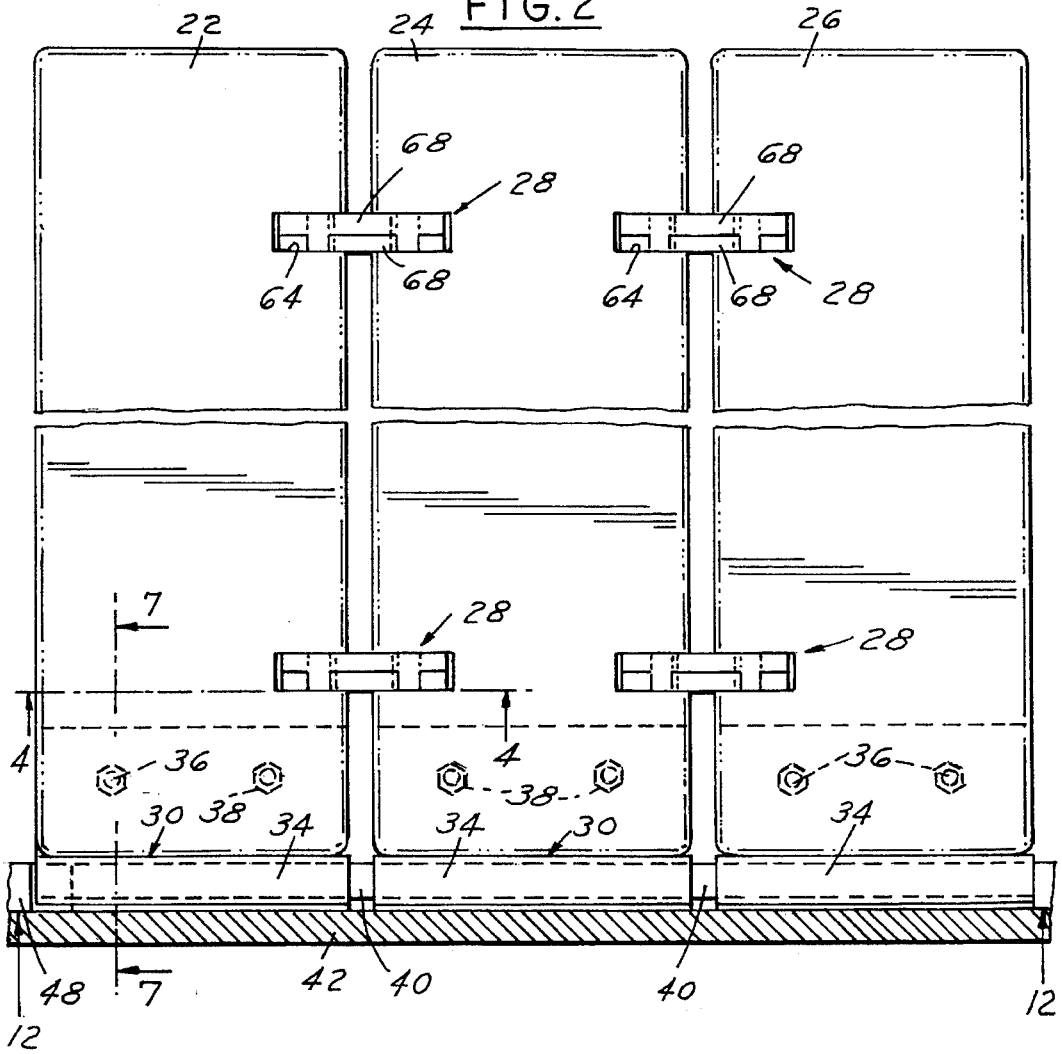
FIG. 2 is a broken plan view of the seat in the configuration illustrated in FIG. 1.
Figure 12:
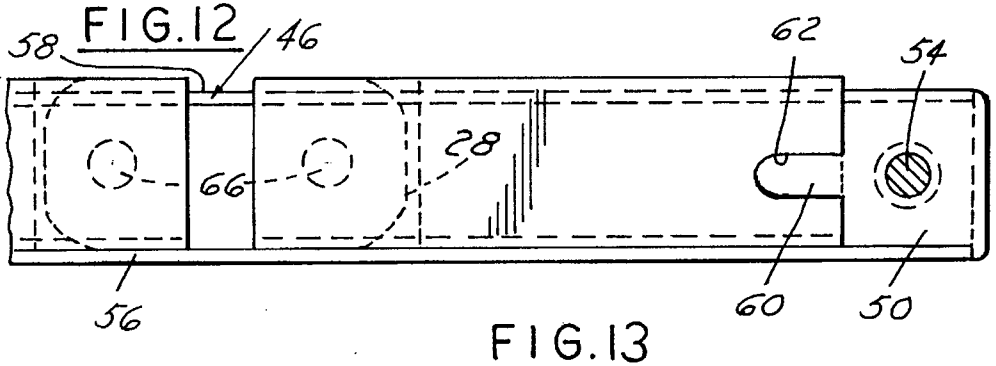
FIG. 12 is an elevational view taken along the line 12—12 in FIG. 2.
Figure 13:
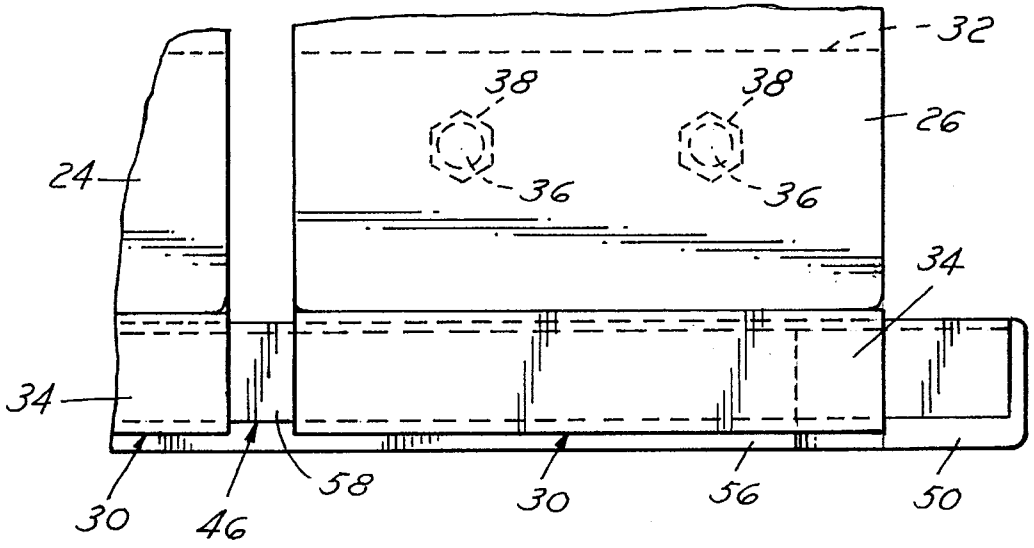
FIG. 13 is a fragmentary plan view of a portion of FIG. 12.
Figure 14:
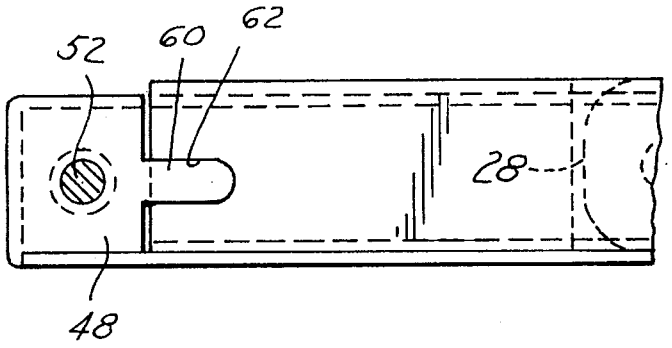
FIG. 14 is a perspective view of a mounting block shown in assembly in FIGS. 1–3 and 12–13.
Figure 14:
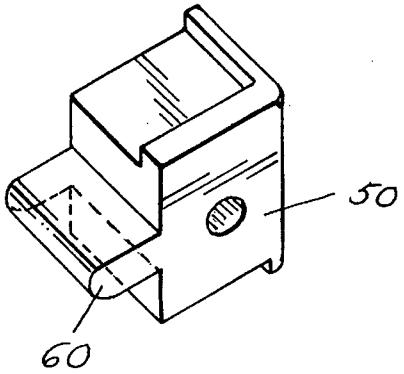

The drawings illustrate a presently preferred embodiment of a foldable bathtub transfer seat 20 in accordance with the invention as comprising three elongated parallel rectangular slats 22,24,26. Adjacent side edges of adjacent slats are pivotally fastened to each other by hinges 28, which will be described in greater detail hereinafter. A rider bracket 30 is affixed to one end of each slat 22,24,26. Each rider bracket 30 has a flat base 32 that underlies and supports the associated slat end, and a rectangular hook-shaped head 34. Each base 32 is fastened to the associated slat by a pair of screws 36 threaded into associated nuts 38. A track 40 is fastened to a vertical building wall 42 adjacent to, and preferably resting upon, the rim of a bathtub 44. Track 40 includes a length 46 of C-shaped channel stock that extends between a pair of opposed mounting blocks 48,50. A pair of screws 52,54 extend into wall 42 through holes at the opposed ends of length 46, and then through holes in blocks 48,50. The lower arm 56 of channel length 46 thus rests on the rim of tub 44, as best seen in FIG. 3, while the upper arm 58 is spaced from the wall forming an elongated slot to receive heads 34 of riders 30. It will be noted in FIGS. 1, 2 and 12 that the length of the hinged slat array between blocks 48,50 is less than the separation between the blocks. The blocks 48,50 have opposed tongues 60, and the end riders 30 have corresponding grooves 62 for fitting over tongues 60. Thus one end slat may be locked to the adjacent block to prevent removal. Friction pads 63 (FIG. 1) of rubber or the like are positioned beneath the wall-remote slat ends to prevent the slats from sliding on the tub rim during use.

Figure 4:
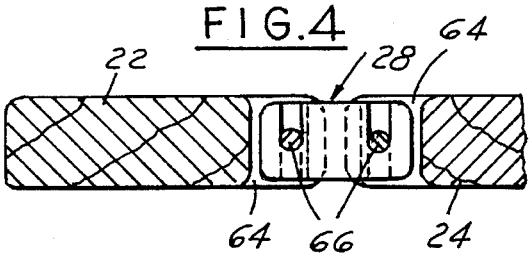
FIG. 4 is a fragmentary sectional view taken substantially along the line 4—4 in FIG. 2.
Figure 5:
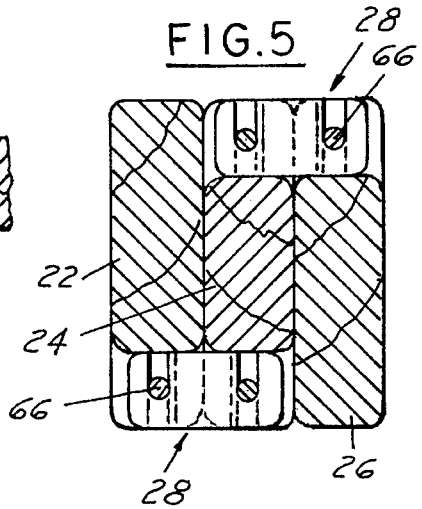
FIG. 5 is a view similar to that of FIG. 4 but showing the slats in stacked configuration.
Figures 6, 7, 8, 9, 10, 11:
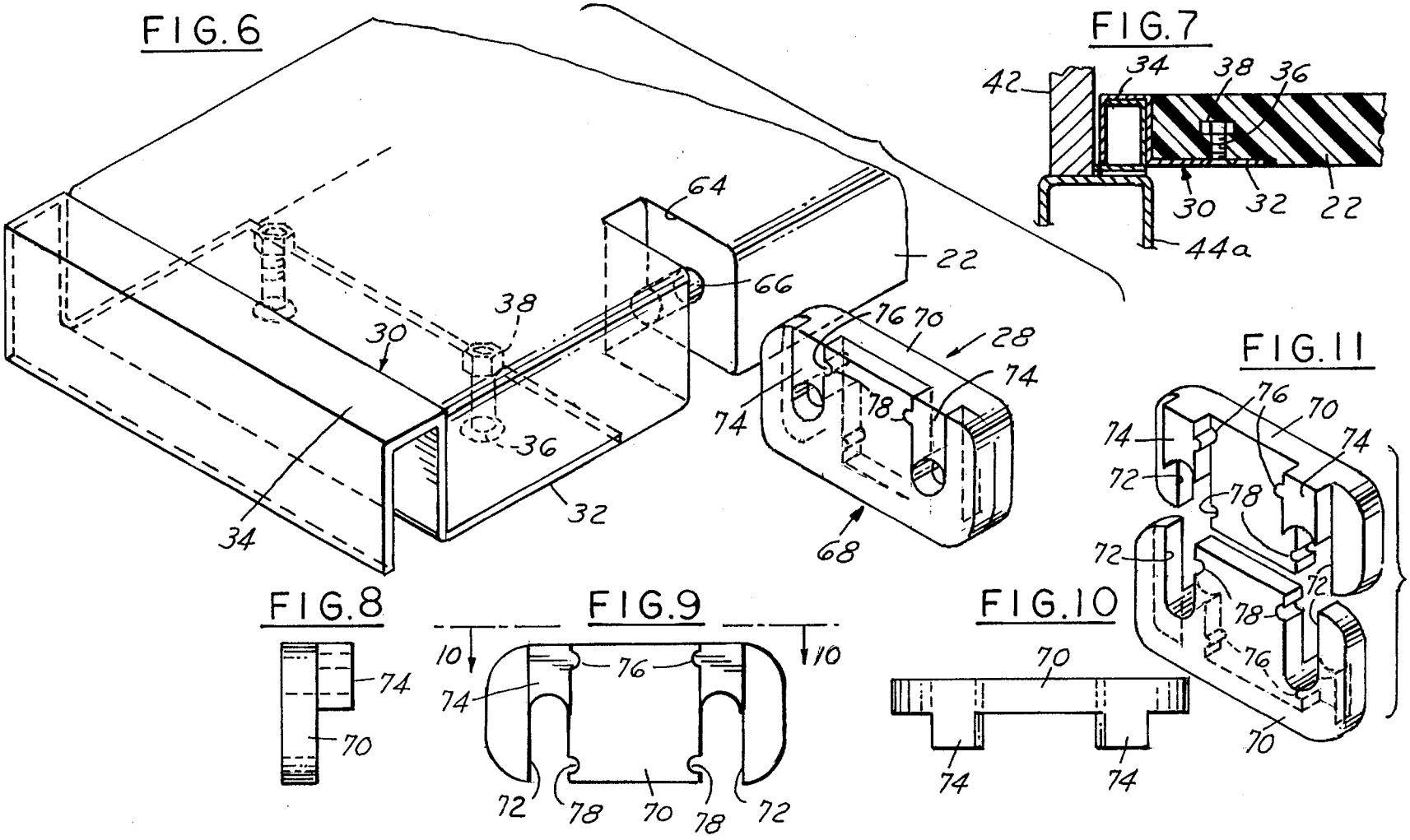
FIG. 6 is a fragmentary exploded perspective view of a portion of a slat with the associated hinge elements.
FIG. 7 is a fragmentary sectional view taken substantially along the line 7—7 in FIG. 2.
FIGS. 8–11 are views that illustrate the hinge clip elements in the preferred embodiment of the invention.
Figure 15:
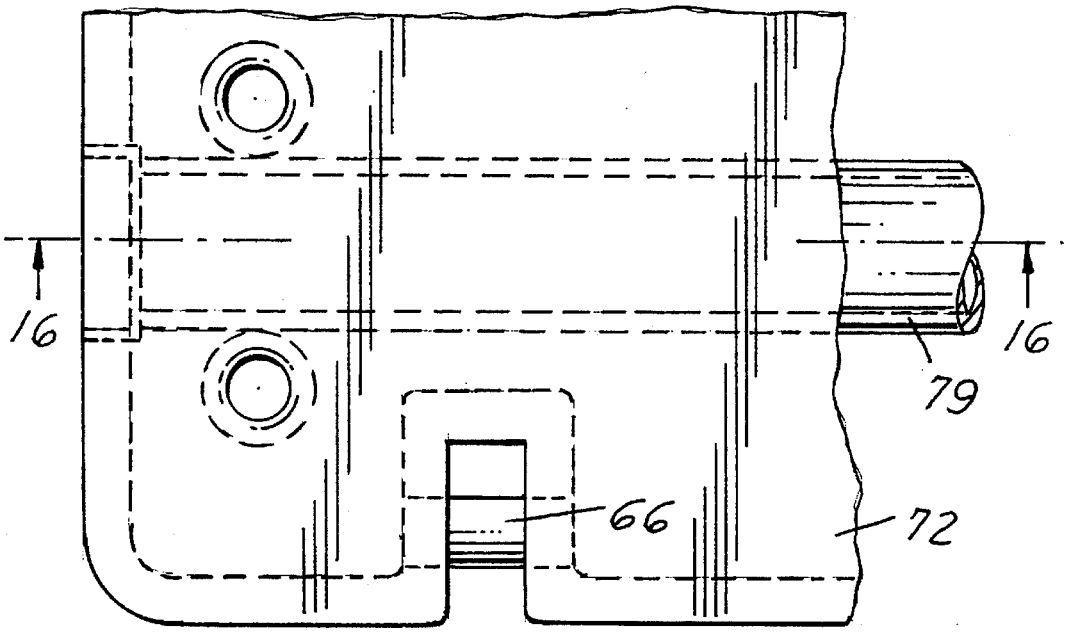
FIG. 15 is a fragmentary plan view of a seat slat in accordance with a modified embodiment of the invention.
Figure 16:
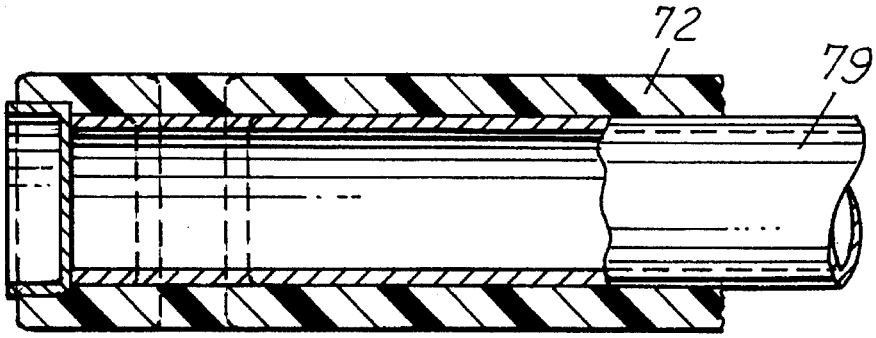
FIG. 16 is a fragmentary sectional view taken substantially along the line 16—16 in FIG. 15.

Hinges 28 comprise a pair of spaced slots 64 along each hinged side edge of slats 22,24,26, each slot 64 being bridged by a hinge pin 66. A pair of identical hinge clips 68 are fastened to each other between adjacent pairs of slats, each pair of hinge clips 68 embracing the hinge pins 66 in the aligned slots 64 in the adjacent slat edges. Each hinge clip 68 has a flat base 70 with a pair of parallel U-shaped slots 72. A pair of unstanding heads 74 extend from base 70 aligned with respective slots 72. Each head 74 has a laterally extending detent button 76, which mates in assembly with an associated detent depression 78 in the other hinge clip of the pair. Thus, detent elements 76,78 snap the two hinge clips to each other so as to embrace hinge pins 66 and assemble the slats pivotally to each other as previously described. Slats 22,24,26 may be solid wood (FIGS. 4–5) or plastic (FIG. 7)

composition. Alternatively, as shown in FIGS. 15 and 16, the slats may be hollow blow-molded polyethylene construction having hinge pins 66 molded therein, and having an internal longitudinally reinforcing tube 79 of stainless steel for example. Hinge clips 68 are likewise preferably of molded plastic composition, as are blocks 48,50. Riders 30 and channel length 46 preferably are of stainless steel construction.

In use, track 40 is fastened to wall 42 at the desired location relative to the lengthwise dimension of tub 44. Slats 22,24,26, which are preassembled with hinges 28, and riders 30 and friction pads 62 at the factory, are then placed over tub 42 by hooking riders 30 into the track channel. The ends of the slats are thus supported on track 40 above the wall-adjacent edge 44*a* of the tub rim and on the rub rim, as shown in FIG. 3, by means of the track abutting the tub rim. The opposing ends of the slats rest upon the outer edge 44*b* of the tub rim. The slats are extended to the coplanar configuration illustrated in FIGS. 1 and 2, and the seat is ready for use to transfer into and out of the tub. When it is desired to remove seat 20 either while in the tub to afford access to the full length of the tub, or while out of the tub for storage, slats 22,24,26 are first folded onto each other so that they are in the stacked facing parallel configuration illustrated in FIG. 5, and then readily removed from track 40.

I claim:

1. A foldable bathtub seat that comprises:

a plurality of elongated parallel rectangular slats, hinge means interconnecting said slats such that said slats are foldable to a configuration in which said slats are in stacked facing engagement parallel with each other and unfoldable to a configuration in which said slats are in a planar array, and means at one end of said slats for mounting said slats to a wall adjacent to the rim of a bathtub such that said slats are foldably and unfoldably supported by the bathtub rim while extending across the rim.

2. The seat set forth in claim 1 wherein said means for mounting said slats to a wall comprises means for removably mounting said slats to the wall.

3. The seat set forth in claim 2 wherein said means for mounting said slats comprises a track, means for affixing said track to the wall adjacent to the rim of the bathtub, and means for removably fastening one end of said slats to said track.

4. The seat set forth in claim 3 wherein said track has an elongated slot, and wherein said means for removably fastening said slats comprises means on said one end of each said slat for removable receipt in said slot.

5. The seat set forth in claim 4 wherein said means for removably fastening said slats comprises a rider on each said slat having a base affixed to and underlying said one slat end to support said end and a hook-shaped head for removable receipt in said slot.

6. The set set forth in claim 5 wherein said track comprises a length of C-shaped channel stock and means at said end of said length for mounting the same to a wall such that the upper edge of said length is spaced from the wall to form said slot.

7. The seat set forth in claim 3 in combination with a bathtub, said track being mounted to the wall on the inside edge of the tub rim, said slats resting on the opposing outside edge of the tub rim.

8. The seat set forth in claim 1 wherein said hinge means comprises hinge pins in said slats and hinge clips pivotally embracing the hinge pins in adjacent slats.

9. The seat set forth in claim 8 wherein each of said hinge clips comprises a flat base having a pair of U-shaped slots, a pair of upstanding heads aligned with said slots and detent means for holding a pair of said hinge clips in opposed fastened engagement with said slots embracing said hinge pins on adjacent slots.

10. The seat set forth in claim 9 wherein said detent means comprises detent buttons on said heads and detent notches on said slots.

11. The seat set forth in claim 1 wherein said slats and said hinge means are constructed such that said slats may be folded into flat facing abutment.

12. The seat set forth in claim 1 wherein said slats are of solid wood.

13. The seat set forth in claim 1 wherein said slats are of hollow blow-molded composition.

14. The seat set forth in claim 13 further comprising reinforcing means molded into each of said slats.

15. The seat set forth in claim 14 wherein said slats are of polyethylene composition.

16. The seat set forth in claim 1 wherein said slats are of plastic composition.

* * * * *